United States Patent [19]

Stein

[11] Patent Number: 4,733,790

[45] Date of Patent: Mar. 29, 1988

[54] COMBINATION DRIP PAN AND CONTAINER LID

[76] Inventor: Donald P. Stein, Rte. 1, Box 432 Fall River Rd., Idaho Springs, Colo. 80452

[21] Appl. No.: 283,272

[22] Filed: Jul. 14, 1981

[51] Int. Cl.[4] ..... B65D 21/02

[52] U.S. Cl. ..... 220/23.83; 220/69

[58] Field of Search ..... 220/69, 256, 85 H, 85 D, 220/85 R, 287, 23.83, 306; 206/515, 514, 508, 509; 248/346.1; 215/100.5; D7/9

[56] References Cited

U.S. PATENT DOCUMENTS

| | | | |
|---|---|---|---|
| Re. 28,720 | 2/1976 | Sedlak | 220/287 |
| 1,688,992 | 10/1928 | Smith | D7/9 X |
| 2,427,487 | 9/1947 | Alexander | D7/9 X |
| 2,670,615 | 3/1954 | Dworak et al. | D7/9 X |
| 2,799,147 | 7/1957 | Crawford, Jr. | 220/23.83 |
| 2,936,926 | 5/1960 | Miller | 220/85 K |
| 2,955,722 | 10/1960 | Antonious | 215/100.5 |
| 3,079,037 | 2/1963 | Schechter | 220/69 |
| 3,173,574 | 3/1965 | Goldsmith | 206/508 |
| 3,606,074 | 9/1971 | Hayes | 220/306 X |
| 3,655,089 | 4/1972 | Tower | 215/100.5 |
| 4,047,329 | 9/1977 | Holt | 220/69 |

FOREIGN PATENT DOCUMENTS

| | | | |
|---|---|---|---|
| 5293 | 12/1932 | Australia | D7/9 |
| 422249 | 1/1935 | United Kingdom | 220/23.83 |
| 525264 | 8/1940 | United Kingdom | 220/23.83 |
| 1379246 | 1/1975 | United Kingdom | 206/508 |

*Primary Examiner*—Stephen Marcus
*Assistant Examiner*—Robert M. Petrik
*Attorney, Agent, or Firm*—Bruce G. Klaas; William P. O'Meara

[57] ABSTRACT

A container lid is adapted to fit over the top or bottom of a liquid container, such as a paint can, and to form a seal with the top or bottom rolled outer rim of the container. The lid is provided with an outwardly extending flange in a central portion of the outer surface of the lid. A drip pan having integral side and bottom walls is provided with a groove in the upper surface of the bottom wall adapted to receive and seat the flange of the lid and to retain the lid in substantially fixed relationship with respect to the drip pan when the flange is received and seated in the groove.

10 Claims, 7 Drawing Figures

COMBINATION DRIP PAN AND CONTAINER LID

BACKGROUND AND SUMMARY OF THE INVENTION

This invention relates to apparatus for catching drips from open liquid containers during use of the containers, and more particularly to a combined liquid container lid and mating drip pan, the drip pan being matable with a plurality of lid sizes to stabilize a liquid container and to catch liquid drips from the container when the lid is fixed to the bottom of the container and the drip pan is mated with the lid.

Liquids, such as paint, are commonly sold in standard sized containers having a large upper opening. For example, paint is commonly sold to the public in pint, quart and gallon-size metallic cans having an upper opening essentially the diameter of the can. In use, a paint brush is typically dipped into paint in the can and then removed, frequently resulting in dripping of paint onto the outside of the can and surrounding surfaces. As paint, or other liquid, runs down the outside of the can, it can collect on a supporting surface for the can causing clean-up problems or damage to the supporting surface.

Many prior attempts have been made to mitigate the problems associated with liquid drips from liquid containers. For example:

(1) U.S. Pat. No. 2,065,591 to Kasik, Dec. 29, 1936 discloses a deep dish drip pan with spring loaded hold-down straps, securing the pan to pail.

(2) U.S. Pat. No. 2,936,926 to Miller, May 17, 1960 discloses a drip pan for trash containers, in which the pan has a central, tight fitting collar to permit the trash container to be placed in the collar and be secured therein. The unit is made of resilient material so as to be retained on the container.

(3) U.S. Pat. No. 2,550,713 to Nicholson, May 1, 1951 discloses a band for attaching to the bottom of a paint can, and the bank is attached by a spring strap to a drip pan. Clips, welded to the pan hold the band in the pan.

(4) U.S. Pat. No. 2,589,967 to Sawyer, Mar. 18, 1952 discloses a drip pan for a drinking cup. This pan has a deep, central collar for the cup. The cup must be of exact size so as to be held in the collar.

(5) U.S. Pat. No. 3,306,074 to Hayes, Sept. 20, 1971 discloses a stepped pan as a securing cover for the paint can, and on reversing the pan, it makes a drip-pan into which the paint can may be set, but not attached.

(6) U.S. Pat. No. 4,071,163 to Martin, Jan. 31, 1978 discloses a multi-step drip pan for a paint can. The steps provide seating for several sizes of cans, and an adjustable length strap with hooks on each end holds a can on the appropriate step in the pan.

The present invention relates to a combination container lid and drip pan assembly wherein a container lid, such as a paint can lid, is adapted to fit over and form a seal with the top or bottom rolled outer rim of a container and is provided with a flange extending outwardly from a central portion of the outer surface of the lid, and wherein a drip pan having integral side and bottom walls is provided with a groove in the upper surface of the bottom wall of the drip pan, the groove in the drip pan being adapted to mate with, receive and seat the flange on the container lid to retain the lid in substantially fixed relationship with respect to the drip pan when the flange is received and seated in the groove.

Included among the objects and advantages of the invention is to provide a combined container lid and drip pan assembly having cooperating means for reversibly mounting the container lid onto the drip pan when the lid is mounted on the bottom of a container, such as a paint can.

Another object of the invention is to provide a reusable container lid and drip pan assembly which is sufficiently inexpensive to provide a throw-away unit.

Another object of the invention is to provide a drip pan adapted to accommodate a plurality of standard size containers and mating container lids.

Yet another object of the invention is to provide a combined container lid and drip pan assembly which is reversibly securable to a container bottom to provide a stabilizing base for the container.

Still another object of the invention is to provide a container lid and drip pan assembly having a container lid, such as a paint can lid, suitable for advertising giveaways.

BRIEF DESCRIPTION OF THE DRAWINGS

These and other advantages and objects of the invention will be apparent from the written description and appended drawings in which.

DESCRIPTION OF THE ILLUSTRATIVE EMBODIMENTS OF THE INVENTION

Figure 2:
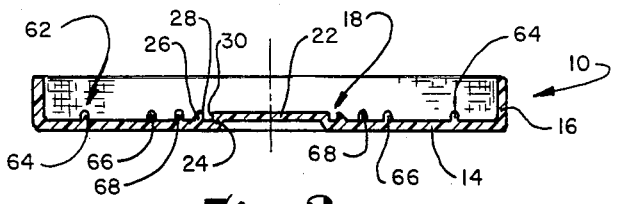
FIG. 2 is a side elevational view in cross-section of the drip pan of FIG. 1, taken along the line 2—2 in FIG. 1.
Figure 3:
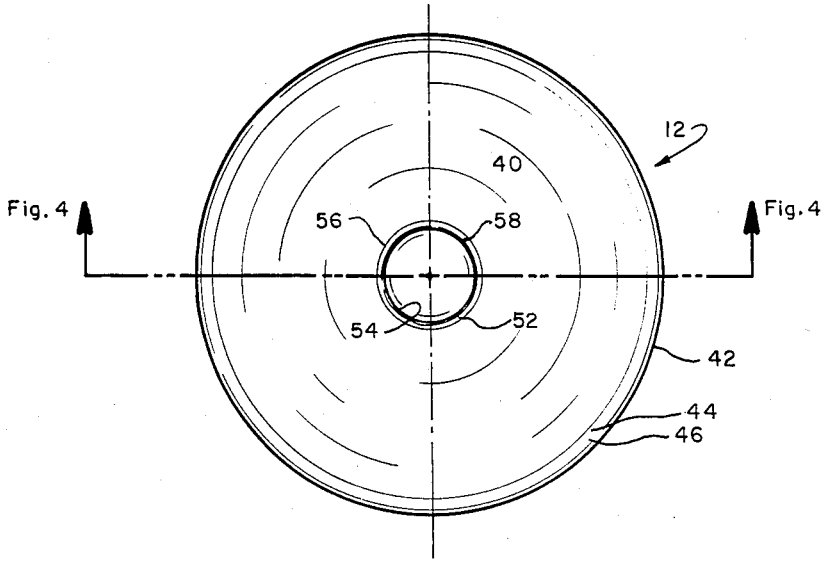
FIG. 3 is a top view of a container lid of the invention.
Figure 4A:
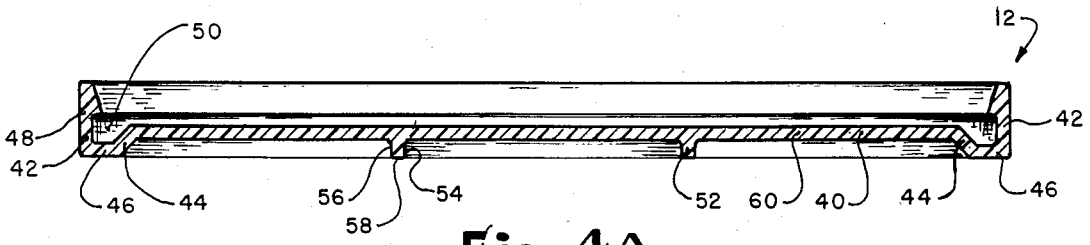
FIG. 4 is a side elevational view in cross-section of container lids of the invention, FIG. 4A being taken along the line 4—4 in FIG. 3, FIGS. 4A, 4B and 4C showing illustrative container lid embodiments for varying standard size containers, such as gallon, quart and pint-size paint cans, respectively.
Figure 4B:
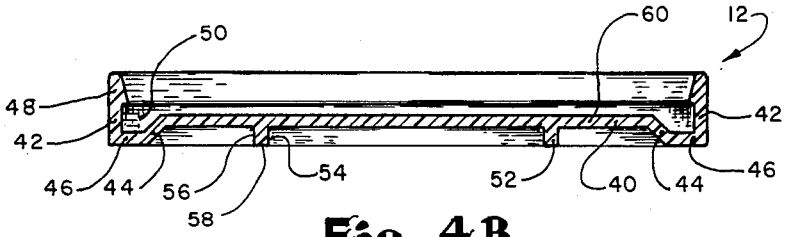
Figure 4C:
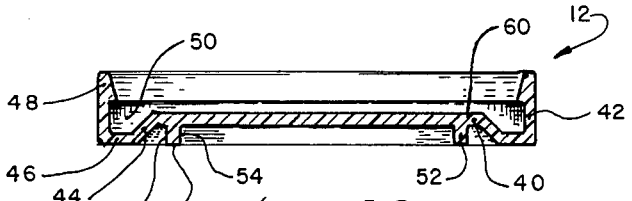
Figure 5:
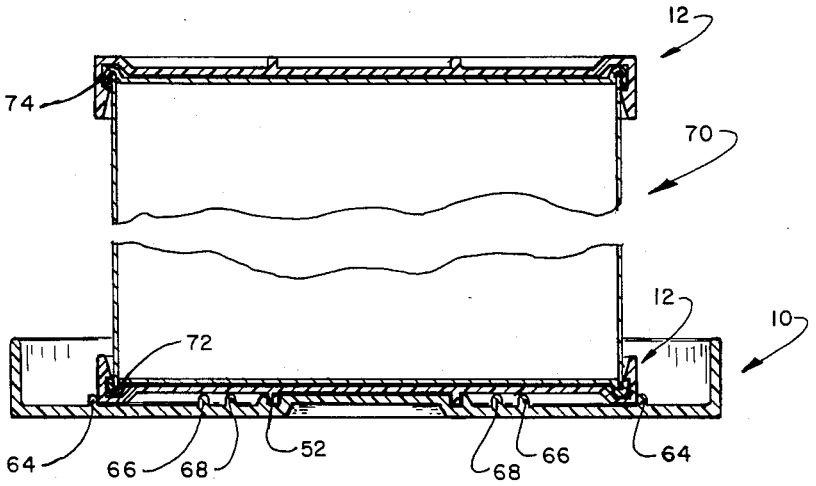
FIG. 5 is a side elevational view in cross-section of the combined container lid and drip pan assembly of the invention in use.

Referring to the drawings, the invention is seen to generally comprise drip pan 10 (FIGS. 1, 2 and 5) and container lid 12 (FIGS. 3, 4 and 5).

Figure 1:
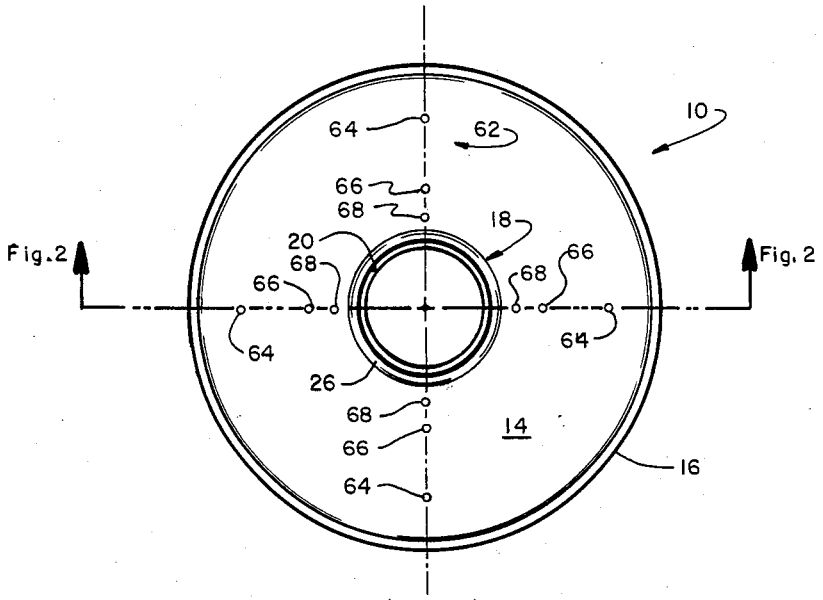
FIG. 1 is a top view of a drip pan of the invention.

As best shown in FIGS. 1 and 2, drip pan 10 is formed by generally flat bottom wall 14 and upstanding sidewall 16 integrally formed with and extending around the periphery of the bottom wall. In the presently particularly preferred and illustrative embodiment of the drawings, bottom wall 14 is shown to have a circular peripheral configuration, although it is to be understood that drip pans having other peripheral configurations such as square, retangular, polygonal, etc., may be employed for this purpose. Sidewall 16 may be formed normal to bottom wall 14, or may be slightly inclined from the perpendicular, as desired. As best shown in FIGS. 1 and 2, the drip pan is further provided with groove means, generally shown at 18, defining a groove in an upper surface of the bottom wall, the groove being adapted to mate with, receive and seat a flange on the container lid 12, as will be hereinafter further described. In the presently particularly preferred and illustrative embodiment of FIGS. 1, 2 and 5, groove means 18 comprises groove 20 defined by a centrally located raised portion 22 of the bottom wall 14, the raised bottom wall portion being integrally connected to the bottom wall by relatively short length, upstanding, interconnecting wall section 24, and by rib 26 extending around and spaced from the interconnecting wall section 24. Rib 26 and interconnecting wall section 24 are provided with side surfaces 28, 30, respectively, oriented parallel to one another so as to define the groove 20 of substantially uniform thickness. In the embodiment shown in the drawings, groove 20 is formed in a circular cross-sectional configuration and is provided in a central portion of bottom wall 14.

Referring now to FIGS. 3–5, the container lid of the invention is shown to comprise a circular base 40 having an upstanding sidewall 42 integrally connected thereto by means of outwardly downwardly inclined wall section 44 and relatively short width annular ring 46, the annular ring 46 being oriented generally parallel to the base 40. A downwardly inwardly extending flange 48 is provided on an upper portion of the sidewall 42 so as to form an annular groove 50, defined by outwardly downwardly inclined wall section 44, annular ring 46, sidewall 42 and downwardly inwardly extending flange 48, for receiving and forming a reversible seal with the top or bottom rolled rim of a container, such as a paint can, as will be hereinafter further described. The container lid 12 further comprises a flange 52 defined by inner sidewall 54, outer sidewall 56 and bottom wall 58, extending normally from the base 40 in a central portion of the base. As best shown in FIG. 4, the bottom wall 58 is preferably formed in coplanar relationship with annular ring 46. The flange 52 is sized and shaped to mate with, and to be received by and seated in groove 20 of the drip pan 10. Thus, in the presently particularly preferred embodiments illustrated in the drawings, flange 52 is formed in a circular cross-sectional configuration having a diameter and wall thickness corresponding to that of groove 20.

As best shown in FIG. 4, the container lid of the invention may be provided in various standard sizes adapted to be used in connection with various standard size containers. Thus, the container lid of FIG. 4A may be designed and sized for use in connection with, for example, a gallon size paint can; that of FIG. 4B for use in connection with a quart size paint can; and that of FIG. 4C for use in connection with a pint size paint can. The corresponding elements of the embodiments of FIGS. 4A, 4B and 4C may be identical in each case with the exception of the width of the portion 60 of the base 40 extending between the flange 52 and the downwardly outwardly inclined wall section 44. In this manner, each of the container lid embodiments of FIGS. 4A, 4B and 4C may be interchangeably mated with a single drip pan of the invention.

Referring again to FIGS. 1, 2 and 5, the drip pan 10 is preferably further provided with means, such as raised projections or nodes 62, for facilitating alignment of the flange 52 of container lid 12 and groove 20 of the drip pan in use of the apparatus of the invention. The nodes 62 are radially spaced on the upper surface of the bottom wall 14 of the drip pan and are oriented so as to cause alignment of the flange 52 and the groove 20 when a lower portion of the sidewall 42 of the container lid is placed in abutting engagement with the nodes, as shown in FIG. 5. The drip pan is preferably provided with a plurality of alignment means, each being adapted to facilitate alignment of different standard sized container lids. Thus, drip pan 10 is provided with an outermost series of nodes 64 adapted to facilitate alignment of, for example, the gallon size container lid of FIG. 4A, an intermediate series of nodes 66 adapted to facilitate alignment of the quart size container lid of FIG. 4B, and an innermost series of nodes 68 adapted to facilitate alignment of the pint size container lid of FIG. 4C. Although each series is shown in FIG. 1 to comprise four radially spaced nodes, it is apparent that three nodes or five or more nodes may be used for this purpose. In addition, other alignment means, such as raised ribs or the like, may be employed.

In use of the invention, the container lid is placed on the bottom of a container 70 with the lower rim 72 of the container in the groove 50 of the lid. The container and lid are then placed in the drip pan with the flange 52 being inserted into and seated in groove 20 of the drip pan. As further shown in FIG. 5, the container lid may also be used to provide a convenient temporary closure for the container by placing the lid over the upper rim 74 of the container.

The drip pan 10 may be made of cardboard or like materials designed for economy and a limited number of uses, or it may be made of treated cardboard, resilient plastic materials, metallic materials or other suitable materials. For example the drip pan may be made of plastics such as polyethylene, polystyrene, urethanes, vinyls, etc. The container lid 12 is preferably made of lightweight plastic materials such as polyethylene, etc.

While the invention has been described in connection with various presently particularly preferred embodiments, various modifications may be apparent from the foregoing description and drawings. Any such modifications are intended to be within the scope of the appended claims except insofar as precluded by the prior art.

I claim:

1. A combination drip pan and container lid, comprising:

a container lid adapted to fit over the top or bottom of a container to form a seal therewith, the container lid having a base, a side wall integrally connected to the base around the periphery thereof, and a flange extending normally outwardly from a central portion of the base, and a drip pan having a bottom wall, a side wall integrally connected to bottom wall and extending vertically outwardly therefrom, and means defining a groove in an upper surface of the bottom wall, the groove being adapted to receive and reversibly seat the flange of the lid so as to reversibly retain the lid in fixed relationship relative to the drip pan when the flange is received and seated in the groove.

2. The apparatus of claim 1 wherein the flange and the groove have a generally circular cross-sectional configuration.

3. The apparatus of claim 1 which further comprises alignment means on the bottom wall of the drip pan for fascilitating alignment of the flange and the groove.

4. The apparatus of claim 3 which further comprises more than one alignment means on the bottom wall, each alignment means being operable for facilitating alignment of the flange of a different size lid with the groove of the drip pan.

5. The apparatus of claim 3 or 4 wherein the alignment means comprises a series of nodes on the upper surface of the bottom wall of the drip pan, the nodes of the series being oriented on the bottom wall so as to cause alignment of the flange and the groove when the sidewall of the lid is placed in simultaneous abutting engagement with each of the nodes of the series.

6. A combination drip pan and container lid, comprising:

a container lid adapted to fit over the top or bottom of a container to form a seal therewith, the container lid having a base, a side wall integrally connected to the base around the periphery thereof, and a flange extending normally outwardly from a central portion of the base, and a drip pan having a bottom wall, a side wall integrally connected to bottom wall and extending vertically outwardly therefrom, and means defining a groove in an upper surface of the bottom wall, the groove being adapted to receive and reversibly seat the flange of the lid so as to reversibly retain the lid in fixed relationship relative to the drip pan when the flange is received and seated in the groove;

wherein said means defining a groove in an upper surface of the bottom wall comprise a centrally located integrally formed raised portion of the bottom wall and integrally formed rib means positioned in annular relationship about said bottom wall raised portion said bottom wall raised portion and rib means comprising opposed parallel side surfaces, wherein said flange is formed in a configuration having a wall thickness corresponding to the distance between said opposed parallel side surfaces of said bottom wall raised portion and said rib means.

7. The apparatus of claim 6 wherein the flange and the groove have a generally circular cross-sectional configuration.

8. The apparatus of claim 6 which further comprises alignment means on the bottom wall of the drip pan for fascilitating alignment of the flange and the groove.

9. The apparatus of claim 8 which further comprises more than one alignment means on the bottom wall, each alignment means being operable for facilitating alignment of the flange of a different size lid with the groove of the drip pan.

10. The apparatus of claim 8 or 9 wherein the alignment means comprises a series of nodes on the upper surface of the bottom wall of the drip pan, the nodes of the series being oriented on the bottom wall so as to cause alignment of the flange and the groove when the sidewall of the lid is placed in simultaneous abutting engagement with each of the nodes of the series.

* * * * *